US011939769B1

(12) United States Patent
Harris

(10) Patent No.: US 11,939,769 B1
(45) Date of Patent: Mar. 26, 2024

(54) SUPPORT FOR REINFORCING MEMBERS IN CONCRETE FOOTING

(71) Applicant: T. J. Harris Company, Knoxville, TN (US)

(72) Inventor: Terry L. Harris, Mascot, TN (US)

(73) Assignee: T. J. Harris Company, Knoxville, TN (US)

( * ) Notice: Subject to any disclaimer, the term of this patent is extended or adjusted under 35 U.S.C. 154(b) by 0 days.

(21) Appl. No.: 18/538,321

(22) Filed: Dec. 13, 2023

Related U.S. Application Data

(63) Continuation-in-part of application No. 18/490,791, filed on Oct. 20, 2023, and a continuation-in-part of application No. 29/911,081, filed on Aug. 29, 2023.

(51) Int. Cl.
*E04C 5/16* (2006.01)

(52) U.S. Cl.
CPC ..... *E04C 5/168* (2013.01)

(58) Field of Classification Search
CPC . E04C 5/16; E04C 5/166; E04C 5/167; E04C 5/168
See application file for complete search history.

(56) References Cited

U.S. PATENT DOCUMENTS

| | | | | |
|---|---|---|---|---|
| 5,107,654 | A * | 4/1992 | Leonardis | E04C 5/20 52/685 |
| 8,099,925 | B1 * | 1/2012 | Coons | E04C 5/20 404/136 |
| 8,312,687 | B2 * | 11/2012 | Yee | E04C 5/168 404/136 |
| D875,505 | S * | 2/2020 | O'Goshi | D8/354 |
| 2004/0194414 | A1 * | 10/2004 | Lowery | E04C 5/20 52/685 |
| 2011/0214382 | A1 * | 9/2011 | Alfonso | E04C 5/168 52/687 |

FOREIGN PATENT DOCUMENTS

| | | | | |
|---|---|---|---|---|
| DE | 102013100149 | A1 * | 4/2014 | E04C 5/168 |

* cited by examiner

*Primary Examiner* — Christine T Cajilig
(74) *Attorney, Agent, or Firm* — Luedeka Neely, P.C.

(57) ABSTRACT

A structure for supporting reinforcement bars includes a base, and first legs extending upwardly from the opposite sides of the base. Attached to shoulders of the first legs are first and second cradles, each having opposing sidewalls that form channels therebetween. Reinforcement bars inserted into the first and second cradles are retained within the channels by retaining members protruding from the opposing sidewalls. A first base support member spans a central opening in the base between the first legs. Second legs extend upwardly from the first base support member and connect to the cradles. Third and fourth legs extend upwardly from opposing ends of the base and connect to the cradles. The structure includes fillets at various points on the cradles, including fillets connecting the cradles to the shoulders of the first legs.

19 Claims, 6 Drawing Sheets

SUPPORT FOR REINFORCING MEMBERS IN CONCRETE FOOTING

FIELD

This disclosure generally relates to the field of structures for supporting concrete reinforcing members. More particularly, this disclosure is directed to a stand for supporting two or more reinforcement bars in a parallel relationship as concrete is poured to form a concrete slab, foundation, or other structure.

BACKGROUND

Reinforcement bars made of steel, glass fiber reinforced polymer, and other materials are typically used in concrete slabs and other concrete structures to provide structural support to the concrete. In slab applications, the bars are usually arranged in regular repeating patterns such as a rectangular lattice and are supported some distance above the ground or other surface on which the slab is to be poured. In foundation applications, concrete footings are poured to support the foundation and resist settling and other problems that may be encountered as a result of soil makeup. For footings bars are typically arranged in a regularly repeating pattern down in a trench or other excavation, with reinforcement bars running parallel to the walls of the foundation and supported above the ground in the trenches. This arrangement allows the concrete poured into the trenches to flow under and around the bars, encapsulating them when the concrete hardens.

Prior structures for supporting the reinforcement bars above the ground within the trenches, also referred to as stands, are lacking in several respects. In particular, prior stand designs do not possess sufficient structural integrity to withstand the combined weight of the reinforcement bars and concrete, do not allow for arrangement of the reinforcement bars prior to retention within the stands, fail to provide stable support, and do not effectively retain the reinforcement bars to adequately keep them in the proper position as the concrete is poured. Additionally, some prior stands have been difficult to use in that multiple pieces are required to capture the reinforcement bars. Further, many of the prior stand designs are difficult to fabricate, increasing the overall cost of the stand.

Accordingly, what is desired is a strong, easy-to-use, and low-cost structure for providing stable support for reinforcement bars in concrete slabs, foundations, and other concrete structures.

SUMMARY

The above and other needs are met by an apparatus for supporting reinforcement bars in a concrete structure. One embodiment of the apparatus includes a base, a first pair of opposing first legs, a second pair of opposing first legs, a first base support member, a first pair of second legs, a first cradle and a second cradle. The base has a lower surface, an opposing upper surface, and a central opening. The first pair of opposing first legs extend upwardly from the upper surface of the base. Each of the first legs of the first pair has a lower end connected to the base and an upper end distally disposed from the lower end. The second pair of opposing first legs also extend upwardly from the upper surface of the base. Each of the first legs of the second pair has a lower end connected to the base and an upper end distally disposed from the lower end. The first base support member is connected to the base and spans the central opening. The first base support member is disposed between the first and second pairs of opposing first legs and has a lower surface and an opposing upper surface. The first pair of second legs extend upwardly from the upper surface of the first base support member. Each of the second legs of the first pair has a lower end connected to the first base support member and an upper end distally disposed from the lower end. The first cradle, which receives and holds a first reinforcement bar, is attached to the upper ends of the first pair of opposing first legs and to the upper end of one of the second legs. The second cradle, which receives and holds a second reinforcement bar in parallel with the first reinforcement bar, is attached to the upper ends of the second pair of opposing first legs and to the upper end of one of the second legs.

In some embodiments, the base has a first end and a second end, and the first pair of opposing first legs is disposed between the first base support member and the first end of the base, and the second pair of opposing first legs is disposed between the first base support member and the second end of the base. A third leg, which extends upwardly from the upper surface of the first end of the base, has a lower end connected to the base and an upper end connected to the first cradle. A fourth leg, which extends upwardly from the upper surface of the second end of the base, has a lower end connected to the base and an upper end connected to the second cradle.

In some embodiments, the central opening of the base is defined by an inner edge that forms a rectangle having filleted corners.

In some embodiments, each of the first legs includes a foot that extends outwardly from the base where each of the first legs is connected to the base.

In some embodiments, each of the second legs includes a foot connected to the upper surface of the first base support member.

In some embodiments, each of the first and second cradles comprises one or more pairs of opposing sidewalls separated by a channel, and each of the sidewalls has a top edge. Retaining members protrude inwardly from the top edges of the opposing sidewalls toward the center of the channel. The retaining members have an upper surface slanting downward at an angle with respect to the first and second upper sidewalls to guide and retain a reinforcement bar within the cradle.

In some embodiments, each of the retaining members further comprises a lower surface that extends inwardly from each of the sidewalls toward the center of the channel.

In some embodiments, the base, first base support member, legs, and cradles comprise a unitary structural element.

In some embodiments, the base, first base support member, legs, and cradles are formed from a continuous piece of thermoplastic material.

In some embodiments, the apparatus includes a third pair of opposing first legs that extend upwardly from the upper surface of the base. Each of the first legs of the third pair have a lower end connected to the base and an upper end distally disposed from the lower end. A second base support member is connected to the base and spans the central opening. The second base support member, which is disposed between the second and third pairs of opposing first legs, has a lower surface and an opposing upper surface. A second pair of second legs extends upwardly from the upper surface of the second base support member. Each of the second legs of the second pair have a lower end connected to the second base support member and an upper end distally disposed from the lower end. The upper end of one of the second pair of second legs is attached to the second cradle. A third cradle, which receives and holds a third reinforcement bar, is attached to the upper ends of the third pair of opposing first legs and to the upper end of one of the second legs.

In some embodiments, a third leg extends upwardly from the upper surface of a first end of the base, and a fourth leg extends upwardly from the upper surface of a second end of the base. The third leg has a lower end connected to the base and an upper end connected to the first cradle, and the fourth leg has a lower end connected to the base and an upper end connected to the third cradle.

Another embodiment is directed to an apparatus for supporting reinforcement bars in a concrete structure. The apparatus includes a base having a lower surface, an opposing upper surface, and a central opening. A first of pair of opposing first legs extend upwardly from the upper surface of the base. Each of the first legs of the first pair have a lower portion connected to the base, an upper portion disposed distally from the lower portion, and a first shoulder extending horizontally from either side of the upper portion. A second of pair of opposing first legs also extend upwardly from the upper surface of the base. Each of the first legs of the second pair have a lower portion connected to the base, an upper portion disposed distally from the lower portion, and a second shoulder extending horizontally form either side of the upper portion.

The apparatus includes a first base support member connected to the base and spanning the central opening. The first base support member is disposed between the first and second pairs of opposing first legs and has a lower surface and an opposing upper surface. A first pair of second legs extend upwardly from the upper surface of the first base support member. Each of the second legs of the first pair has a lower portion connected to the first base support member, an upper portion disposed distally from the lower portion, and a first neck member extending horizontally from the upper portion.

The apparatus includes a first cradle that forms a first channel for receiving and holding a first reinforcement bar. The first cradle includes a first pair of opposing sidewalls connected to the first shoulder of a one of the first legs of the first pair, wherein the first channel is disposed between the first pair of opposing sidewalls. The first cradle also includes a second pair of opposing sidewalls connected to the first shoulder of another of the first legs of the first pair, wherein the first channel is disposed between the second pair of opposing sidewalls. A first central bar-support member is connected to a first neck member of a second leg and connects the first pair of opposing sidewalls to the second pair of opposing sidewalls.

The apparatus includes a second cradle that forms a second channel for receiving and holding a second reinforcement bar substantially in parallel with the first reinforcement bar. The second cradle includes a third pair of opposing sidewalls that are connected to the second shoulder of a one of the first legs of the second pair, wherein the second channel is disposed between the third pair of opposing sidewalls. A fourth pair of opposing sidewalls is connected to the second shoulder of another of the first legs of the second pair, wherein the second channel is disposed between the fourth pair of opposing sidewalls. A second central bar-support member is connected to a first neck member of a second leg and connects the third pair of opposing sidewalls to the fourth pair of opposing sidewalls.

In some embodiments, the first cradle includes first upper fillets that connect the first pair of opposing sidewalls to the first shoulder of the first one of the first pair of first legs, and second upper fillets that connect the second pair of opposing sidewalls to the first shoulder of the second one of the first pair of first legs. Similarly, the second cradle includes third upper fillets that connect the third pair of opposing sidewalls to the second shoulder of the first one of the second pair of first legs, and fourth upper fillets that connect the fourth pair of opposing sidewalls to the second shoulder of the second one of the second pair of first legs.

In some embodiments, the base has a first end and a second end, and the first pair of the plurality of pairs of opposing first legs are disposed between the first base support member and the first end of the base, and the second pair of opposing first legs are disposed between the first base support member and the second end of the base. A third leg, which extends upwardly from the upper surface of the first end of the base, has a lower portion connected to the base, an upper portion disposed distally from the lower portion, and a second neck member extending horizontally from the upper portion of the third leg. The second neck member is connected to the central bar-support member of the first cradle. A fourth leg, which extends upwardly from the upper surface of the second end of the base, has a lower portion connected to the base, an upper portion disposed distally from the lower portion, and a third neck member that extends horizontally from the upper portion of the fourth leg. The fourth neck member is connected to the central bar-support member of the second cradle.

In some embodiments, the base is rectangular and has opposing and parallel first and second ends and opposing and parallel first and second sides disposed between the first and second ends. The first base support member has a first end connected to the first side of the base, and a second end connected to the second side of the base.

In some embodiments, first retaining members protrude inwardly from the top edges of the opposing first and second sidewalls of the first cradle toward the first channel. The first retaining members have an upper surface slanting downward at an angle with respect to the first and second sidewalls to guide and retain a reinforcement bar within the first cradle. Similarly, second retaining members protrude inwardly from the top edges of the opposing first and second sidewalls of the second cradle toward the second channel. The second retaining members have an upper surface slanting downward at an angle with respect to the first and second sidewalls to guide and retain a reinforcement bar within the second cradle.

In some embodiments, each of the first and second retaining members includes a lower surface that extends inwardly from each of the sidewalls toward the corresponding first or second channel.

In some embodiments, the apparatus includes a third of pair of opposing first legs that extend upwardly from the upper surface of the base. Each of the first legs of the third pair have a lower portion connected to the base, an upper portion disposed distally from the lower portion, and a third shoulder extending horizontally form either side of the upper portion. A second base support member is connected to the base and spans the central opening. The second base support member is disposed between the second and third pairs of opposing first legs and has a lower surface and an opposing upper surface. A second pair of second legs extends upwardly from the upper surface of the second base support member. Each of the second legs of the second pair have a lower portion connected to the first base support member, an upper portion disposed distally from the lower portion, and a second neck member extending horizontally from the upper portion. One of the second neck members of the second pair of second legs is attached to the second cradle. This embodiment includes a third cradle that forms a third channel for receiving and holding a third reinforcement bar. The third cradle includes a fifth pair of opposing sidewalls connected to the third shoulder of one of the first legs of the third pair, wherein the third channel is disposed between the fifth pair of opposing sidewalls. The third cradle also includes a sixth pair of opposing sidewalls connected to the third shoulder of another of the first legs of the third pair, wherein the third channel is disposed between the sixth pair of opposing sidewalls. The third cradle further includes a third central bar-support member that connects the fifth pair of opposing sidewalls to the sixth pair of opposing sidewalls. The third central bar-support member is connected to one of the second neck members of one of the second legs of the second pair.

In some embodiments, the apparatus includes a third leg that extends upwardly from the upper surface of a first end of the base. The third leg has a lower portion connected to the base, an upper portion disposed distally from the lower portion, and a third neck member extending horizontally from the upper portion of the third leg, wherein the third neck member is connected to the first central bar-support member of the first cradle. This embodiment also includes a fourth leg extending upwardly from the upper surface of the second end of the base. The fourth leg has a lower portion connected to the base, an upper portion disposed distally from the lower portion, and a fourth neck member that extends horizontally from the upper portion of the fourth leg, wherein the fourth neck member is connected to the third central bar-support member of the third cradle.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 9:
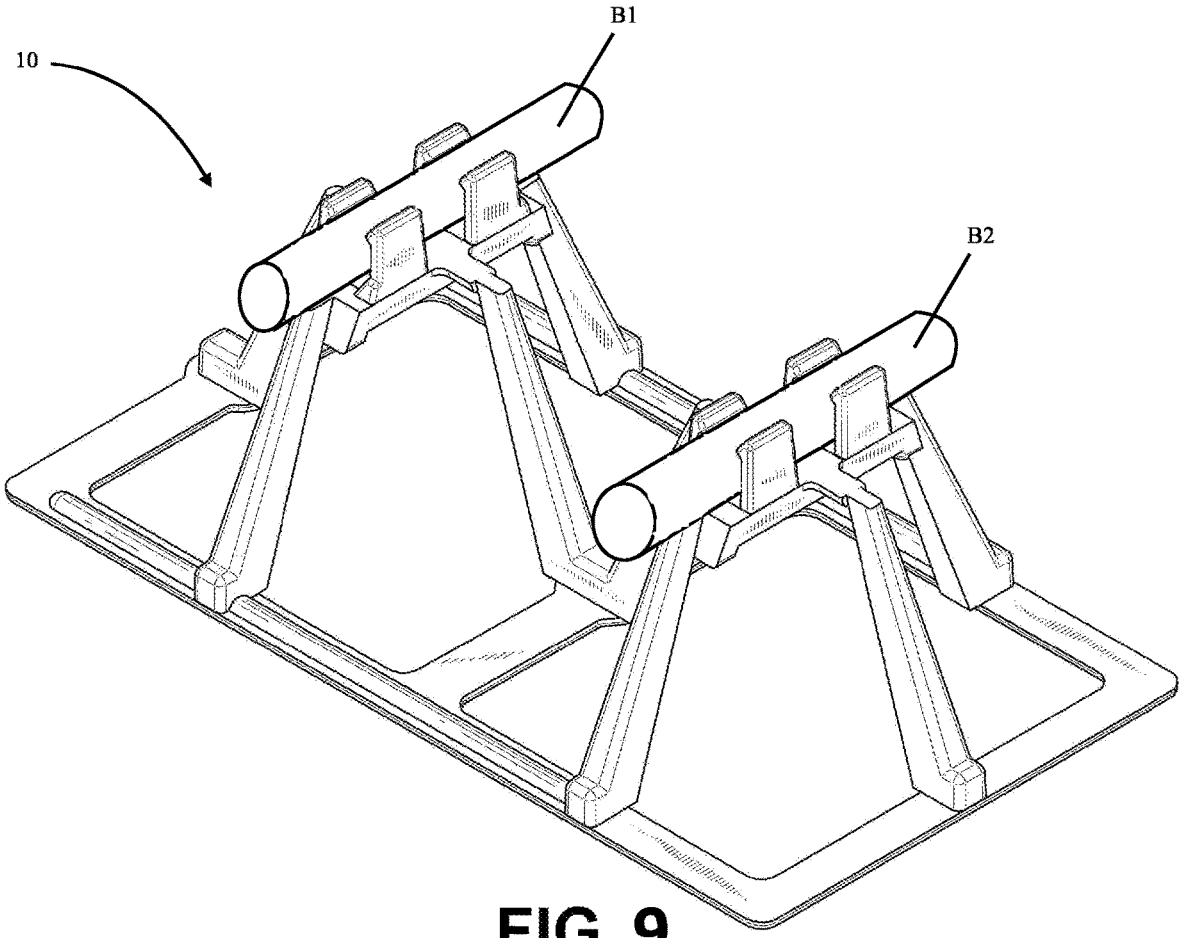
FIG. 9 depicts the embodiment of FIGS. 1-8 supporting two concrete reinforcement bars.

Depicted in FIGS. 1-9 is a structure 10 for supporting concrete reinforcement bars within a poured concrete footing, also referred to herein as a footing stand 10. As shown in FIG. 9, the stand 10 may be used to hold concrete reinforcement bars B1 and B2 in a substantially parallel relationship as concrete is poured around the stand 10 and the bars B1 and B2 to form a concrete footing or other similar structure. As one skilled in the art will appreciate, many such stands 10 may be used to support a parallel arrangement of reinforcement bars in a concrete footing.

Figure 1:
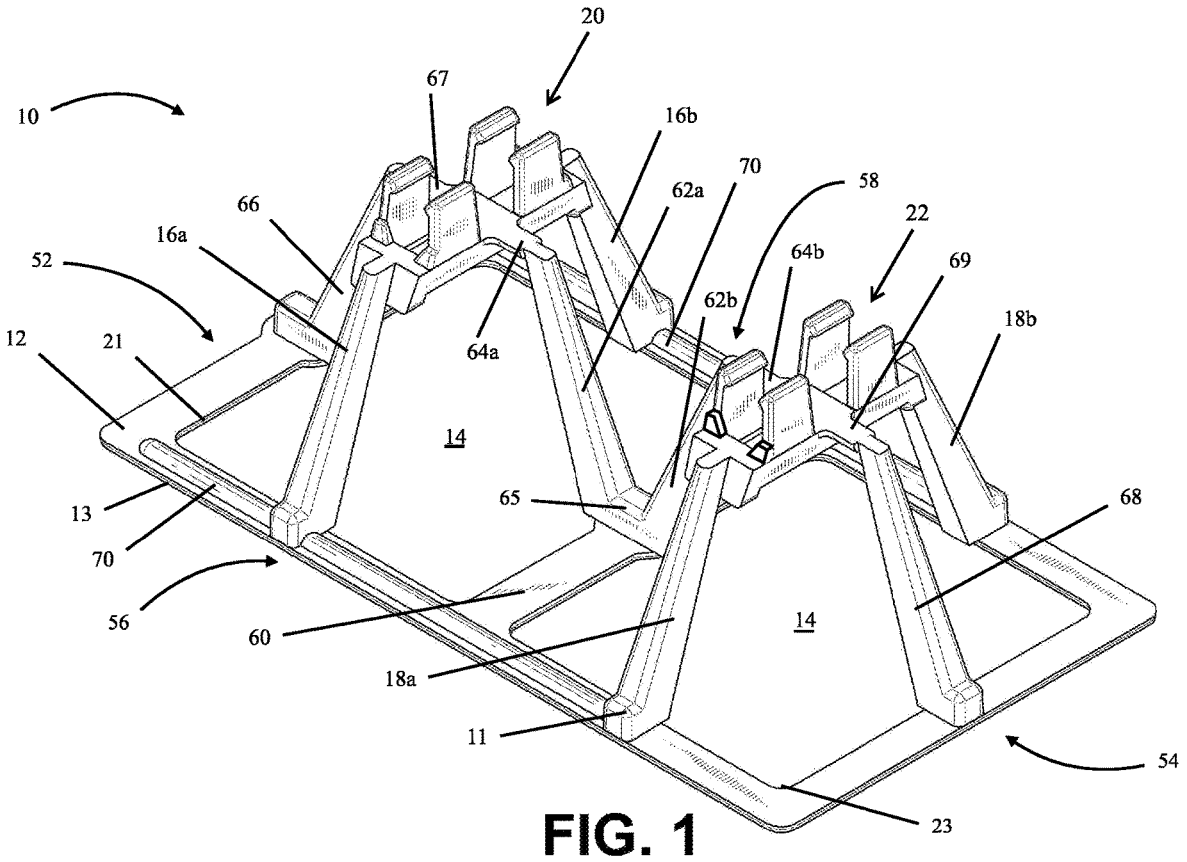
FIG. 1 is a top perspective view of a structure for supporting two concrete reinforcement bars in accordance with one embodiment of the present disclosure.
Figure 2:
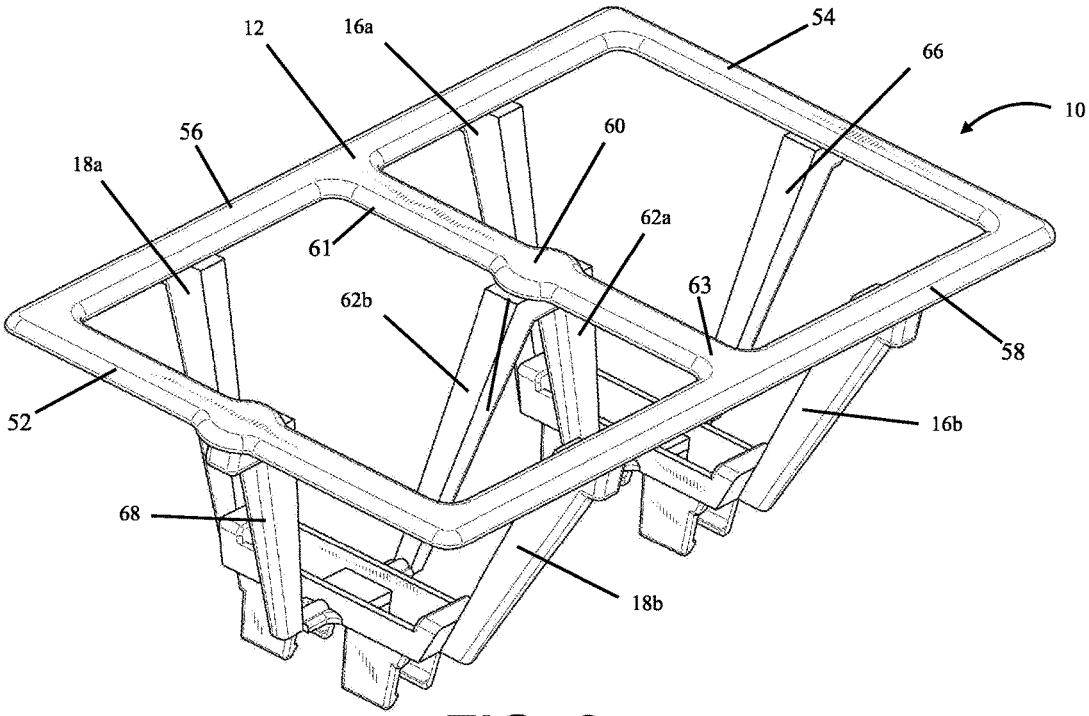
FIG. 2 is a bottom perspective view of a structure for supporting two concrete reinforcement bars in accordance with one embodiment.

Shown in FIG. 1, the stand 10 includes a base 12 that is preferably rectangular, formed from a first end 52 and a second end 54, which are opposing and parallel, and a first side 56 and a second side 58, which are also opposing and parallel. Within the base 12 there is preferably a central opening 14. Preferably, the opening 14 is defined by an inner edge 21 forming a rectangle having filleted inner corners 23, which provide the stand 10 with a larger footprint as the stand 10 is submerged in concrete, effectively stabilizing the stand 10 and preventing the arrangement of reinforcement bars from shifting with the flow of the concrete.

Situated around the opening 14 are pairs of legs, including opposing first and second pairs of first legs 16*a* and 16*b*, and 18*a* and 18*b*, respectively. The first legs 16*a* and 18*a* are attached at their lower extremities to the first side 56 and of the base 12 and extend upwardly therefrom. The first legs 16*b* and 18*b* are attached at their lower extremities to the second side 58 of the base 12 and extend upwardly therefrom. Situated around the opening 14 of a preferred embodiment are a third leg 66 and a fourth leg 68 attached at their lower extremities to the first end 52 and second end 54 of the base 12, respectively, and extending upwardly therefrom.

In some embodiments, one or more reinforcement ribs 70 may also be disposed along the upper surface of the sides 56 and 58 of the base 12 between the first and second pairs of first legs 16*a*-16*b* and 18*a*-18*b*, as shown in FIG. 1. The reinforcement ribs 70 provide additional strength to the base 12, preventing warping as the base 12 is loaded with reinforcement bars and concrete.

Preferably, one or more of the legs 16*a*-6*b*, 18*a*-18*b*, 66, and 68 includes a foot 11 extending outwardly from the base 12 at the attachment point between the base 12 and the lower extremities of the legs 16*a*-16*b*, 18*a*-18*b*, 66, and 68. In some embodiments, the foot 11 may extend outwardly beyond the outer edge 13 of the base 12. The foot 11 provides increased stabilization to the stand 10 and reinforces the attachment points between the base 12 and legs 16*a*-16*b*, 18*a*-18*b*, 66, and 68, which frequently bear great stresses as the stand 10 is loaded with concrete reinforcement bars and submerged in concrete. The legs 16*a*-16*b*, 18*a*-18*b*, 66, and 68 of the preferred embodiment are generally rectangular in cross-section and may be somewhat thicker at their lower extremities than at their upper extremities. Additionally, in some embodiments, the reinforcement ribs 70 may be disposed along the upper surfaces of the sides 56 and 58 of the base 12 and connected to the feet 11, thereby further strengthening both the base 12 and the attachment points between the base 12 and legs 16*a*-16*b* and 18*a*-18*b*.

Preferably, the central opening 14 is spanned by a first base support member 60 having a first end 61 connected to the first side 56 of the base 12 and a second end 63 connected to the second side 58 of the base 12. Preferably, the width of the first base support member 60 is greater than the width of either of the sides 56 and 58 or either of the ends 52 and 54 of the base 12. The first base support member 60 provides additional strength and rigidity to the base 12, thereby preventing the base 12, and thus the stand 10, from warping under the combined weight of the reinforcement bars and the concrete.

In addition to the legs 16*a*-16*b*, 18*a*-18*b*, 66, and 68 attached to the base 12, the stand 10 further includes second legs 62*a* and 62*b* attached at their lower extremities to a central portion of the first base support member 60 and extending upwardly therefrom. Preferably, one or more of the second legs 62*a*-62*b* includes a foot 11 extending inwardly toward the central portion of the first base support member 60. In some embodiments, the feet 11 of the second legs 62*a*-62*b* are connected in the central portion of the support member 60. Like the feet 11 of the legs 16*a*-16*b*, 18*a*-18*b*, 66, and 68, the feet 11 of the second legs 62*a*-62*b* provide increased stabilization to the stand 10. Each foot 11 reinforces the attachment point between the first base support member 60 and the corresponding second leg 62*a*-62*b*, which frequently bears great stresses inward, toward the bar support member 60 as the stand 10 is loaded with concrete reinforcement bars and submerged in concrete. The second legs 62*a*-62*b* of the preferred embodiment are generally rectangular in cross-section and may be somewhat thicker at their lower extremities than at their upper extremities.

Figure 3:
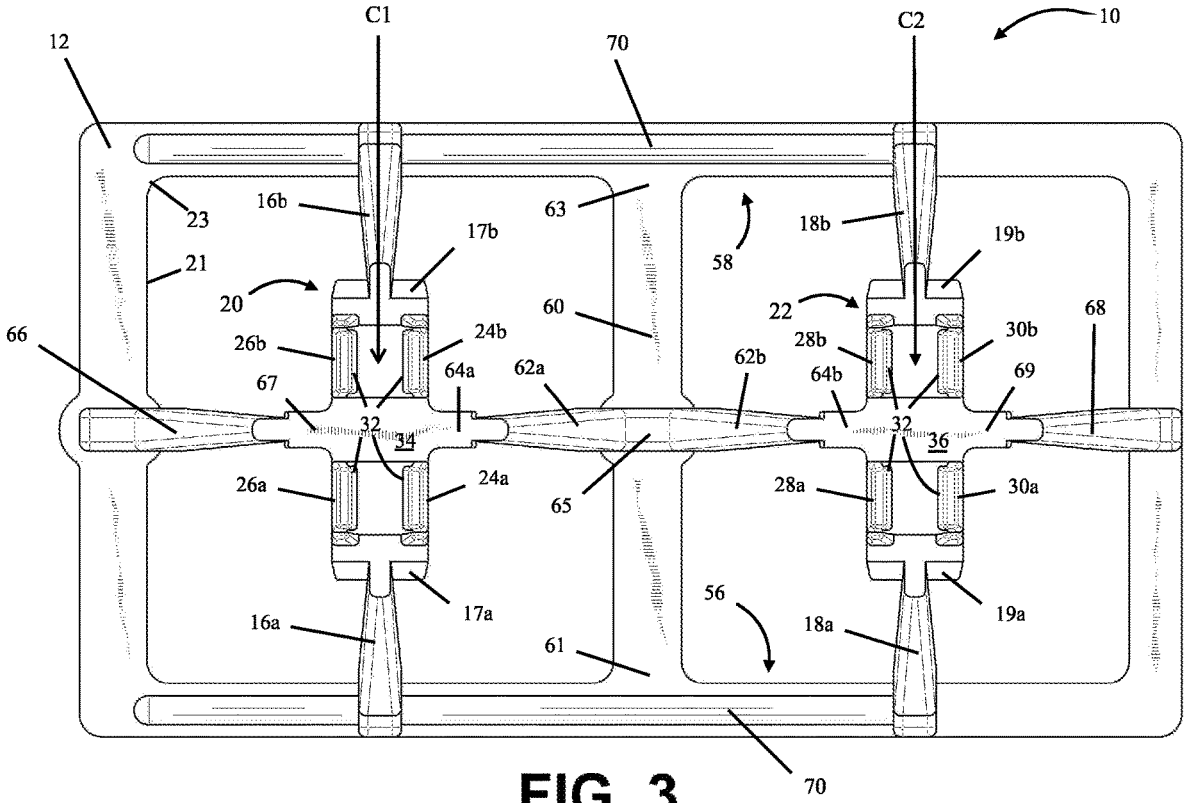
FIG. 3 is a top plan view of a structure for supporting two concrete reinforcement bars in accordance with one embodiment.
Figure 4:
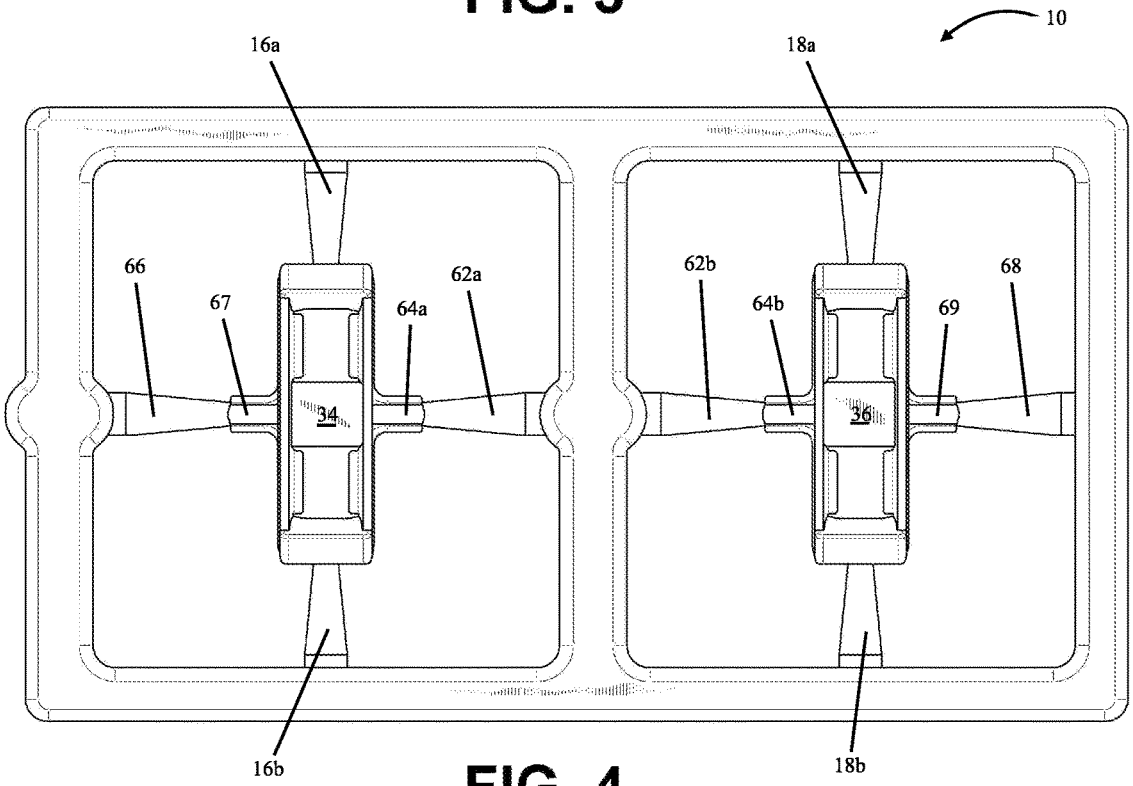
FIG. 4 is a bottom plan view of a structure for supporting two concrete reinforcement bars in accordance with one embodiment.

As shown in FIGS. 3 and 4, a first shoulder 17*a* extends horizontally outwardly from the upper extremity of the first leg 16*a*, and a first shoulder 17*b* extends horizontally outwardly from the upper extremity of the first leg 16*b*. The first shoulder 17*a* supports opposing sidewalls 24*a* and 26*a*, and the second shoulder 17*b* supports opposing sidewalls 24*b* and 26*b* that together form a first cradle 20 for receiving and holding a first reinforcement bar.

Similarly, a second shoulder 19*a* extends horizontally outwardly from the upper extremity of the first leg 18*a*, and a second shoulder 19*b* extends horizontally outwardly from the upper extremity of the first leg 18*b*. The second shoulder 19*a* supports opposing sidewalls 28*a* and 30*a*, and the second shoulder 19*b* supports opposing sidewalls 28*b* and 30*b* that together form a second cradle 22 for receiving and holding a second reinforcement bar.

Shown in FIGS. 3 and 4, attached to the upper extremity of the second leg 62*a* is a central bar-support member 34 connected between and to the first and second pairs of opposing sidewalls 26*a*-24*a* and 26*b*-24*b*. Preferably, the central bar-support member 34 is attached to the second leg 62*a* via a first neck member 64*a*. Similarly, attached to the upper extremity of the second leg 62*b* is a central bar-support member 36 connected between and to the first and second pairs of opposing sidewalls 28*a*-30*a* and 28*b*-30*b*. Preferably, the central bar-support member 36 is attached to the second leg 62*b* via a first neck member 64*b*.

Likewise, the third leg 66 of a preferred embodiment is attached to the central bar-support member 34 via a second neck member 67, and the fourth leg 68 is attached to the central bar-support member 36 via a third neck member 69.

Figure 5:
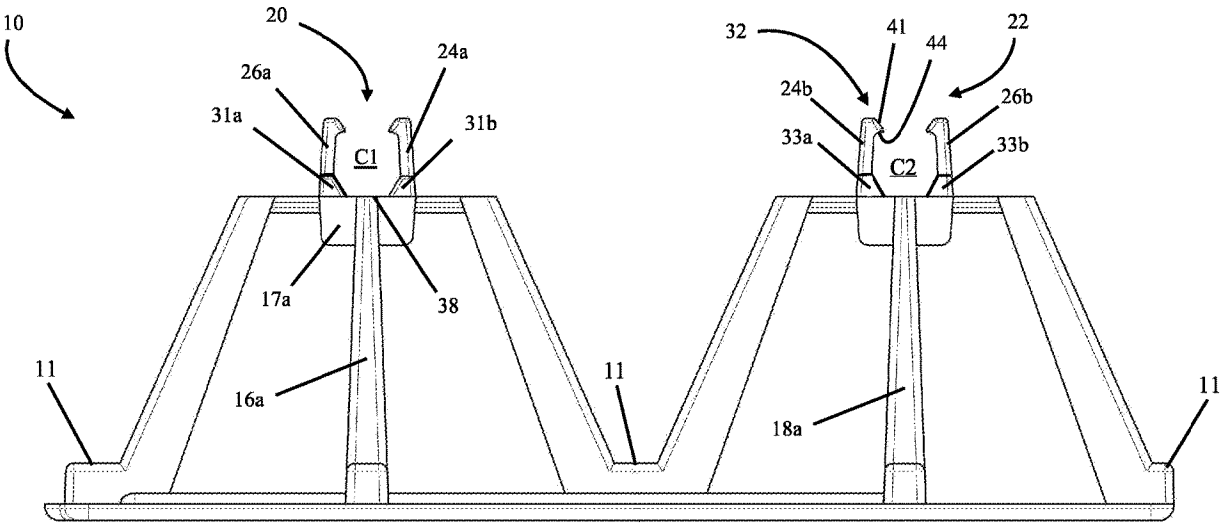
FIG. 5 is a first elevation view of a structure for supporting two concrete reinforcement bars in accordance with one embodiment.
Figure 6:
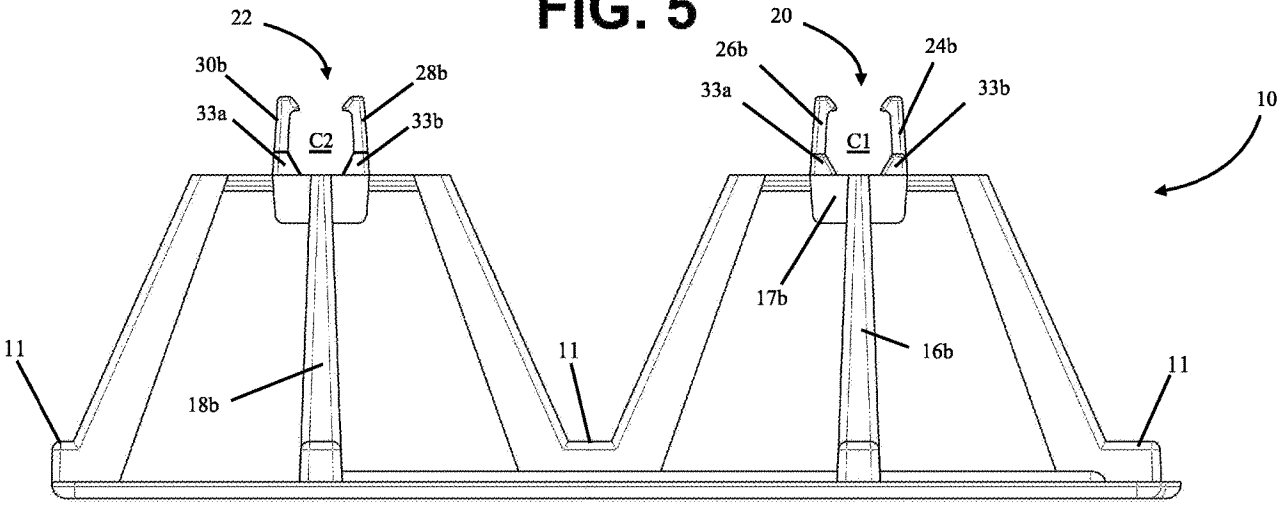
FIG. 6 is a second elevation view of a structure for supporting two concrete reinforcement bars in accordance with one embodiment.
Figure 7:
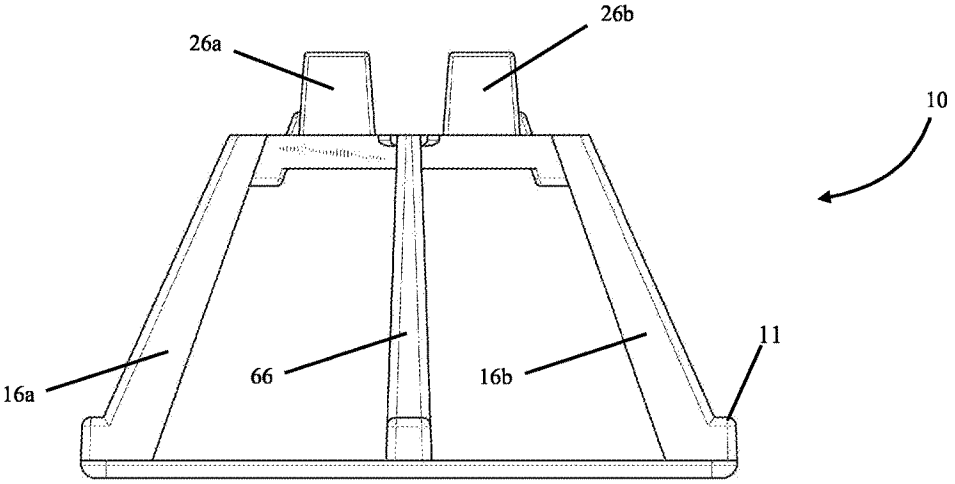
FIG. 7 is a third elevation view of a structure for supporting two concrete reinforcement bars in accordance with one embodiment.
Figure 8:
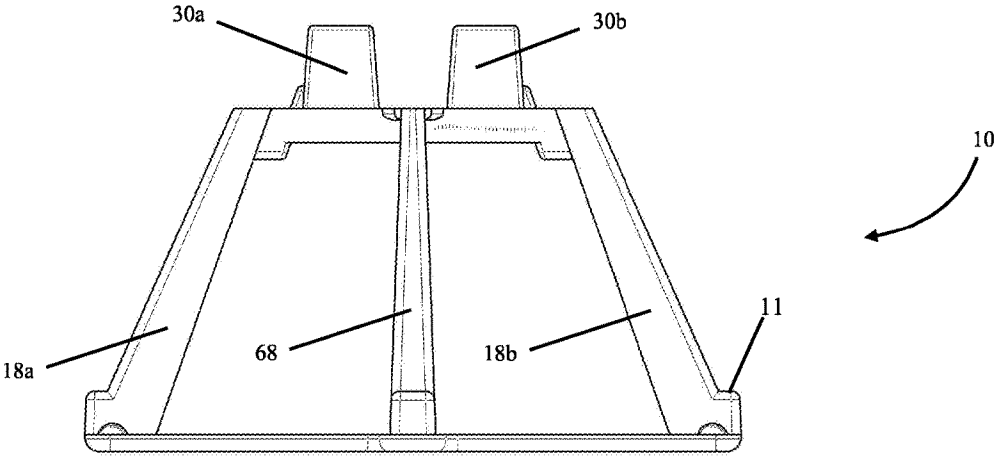
FIG. 8 is a fourth elevation view of a structure for supporting two concrete reinforcement bars in accordance with one embodiment.

In preferred embodiments, one or both of the first cradle 20 and second cradle 22 may also include various fillets that connect and reinforce various portions of the cradles in order to provide strength and stability to the stand 10 as it is loaded with reinforcement bars B1 and B2 and submerged in concrete. For example, as shown in FIGS. 1, 5, and 6, the first cradle 20 has fillets 31*a* and 31*b* that connect the sidewalls 26*a* and 24*a* to the shoulder 17*a* at the upper extremity of the first leg 16*a*, and fillets 33*a* and 33*b* that connect the sidewalls 26*b* and 24*b* to the shoulder 17*b* at the upper extremity of the first leg 16*b*. Similarly, the second cradle 22 has fillets 31*a* and 31*b* that connect the sidewalls 28*a* and 30*a* to the shoulder 19*a*, and fillets 33*a* and 33*b* that connect the sidewalls 28*b* and 30*b* to the shoulder 19*b*. In addition to reinforcing and stabilizing high stress points in the stand 10, the fillets 31*a*-31*b* and 33*a*-33*b* ensure that the reinforcement bars B1 and B2, which are typically cylindrically shaped, fit more snugly into place within the first and second cradles 20 and 22. Thus, the fillets 31*a*-31*b* and 33*a*-33*b* further stabilize the stand 10 when it is loaded with reinforcement bars and concrete.

Preferred embodiments include retaining members 32 that are disposed on the inner surfaces of the opposing sidewalls 24*a*-26*a*, 24*b*-26*b*, 28*a*-30*a* and 28*b*-30*b* of the cradles 20 and 22. The retaining members 32 extend slightly over the channels C1 and C2 to prevent the reinforcement bars from lifting out of the first and second cradles 20 and 22. As shown in FIG. 5, each of the retaining members 32 includes an upper surface 41 extending downward at an angle from the top edges of opposing sidewalls 24*a*-26*a*, 24*b*-26*b*, 28*a*-30*a*, and 28*b*-30*b*. The retaining members 32 also preferably include a lower surface 44 extending slightly over the channels C1 and C2 from an inner surface of the opposing sidewalls 24*a*-26*a*, 24*b*-26*b*, 28*a*-30*a*, and 28*b*-30*b*. Thus, when reinforcement bars are pressed downward into the cradles 20 and 22, the opposing retaining members 32 smoothly guide the reinforcement bars by virtue of the upper surfaces 41 and retain the reinforcement bars by virtue of the lower surfaces 44, thereby preventing movement and stabilizing the stand 10. As the reinforcement bars are pressed downward into the cradles 20 and 22, the upper surfaces 41 move outward to cause the opposing sidewalls 24*a*-26*a*, 24*b*-26*b*, 28*a*-30*a* and 28*b*-30*b* to flex slightly outward and allow the reinforcement bars to snap into the channels C1 and C2. The lower surfaces 44 of the retaining members 32 extend squarely into the channels C1 and C2 and preferably have square or barbed corners for effectively capturing the reinforcement bars within the channels C1 and C2. Compared to prior stand designs that have used opposing tapered slots in a conical or cylindrical wall, the opposing sidewalls 24*a*-26*a*, 24*b*-26*b*, 28*a*-30*a* and 28*b*-30*b* and the retaining members 32 of the present invention provide a significantly improved retention mechanism.

Figure 10:
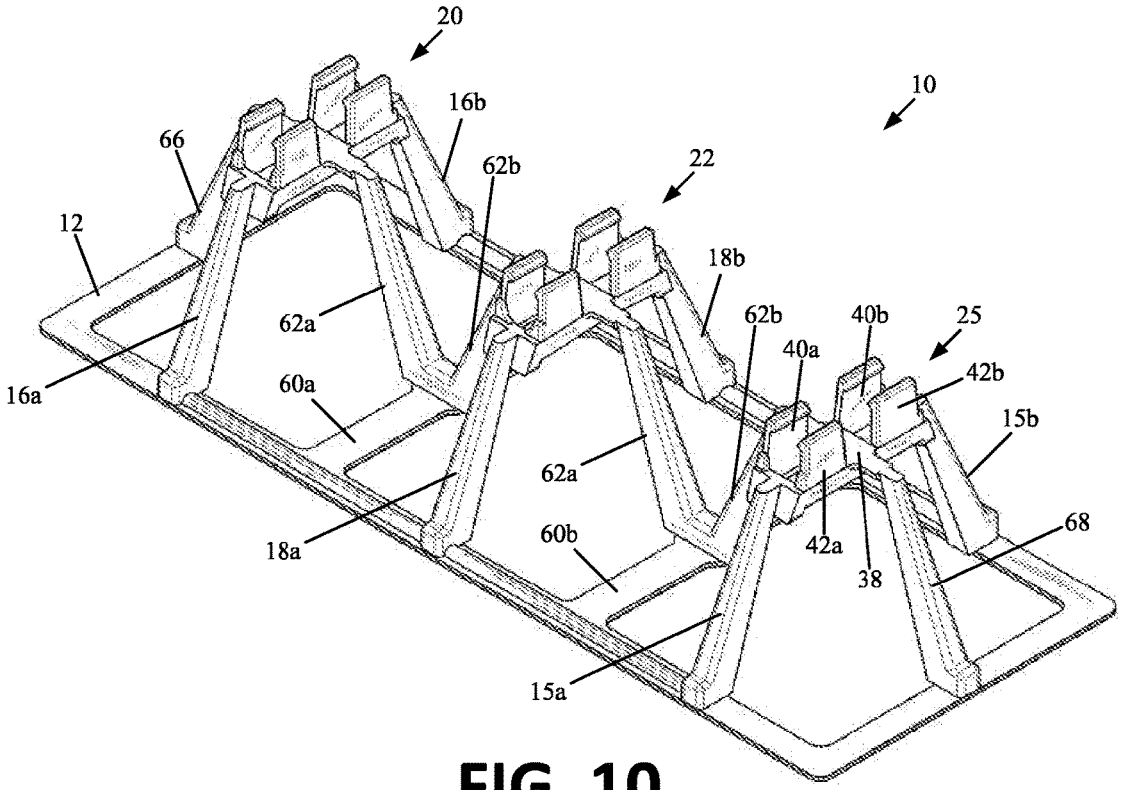
FIG. 10 is a top perspective view of a structure for supporting three concrete reinforcement bars in accordance with one embodiment of the present disclosure.
Figure 11:
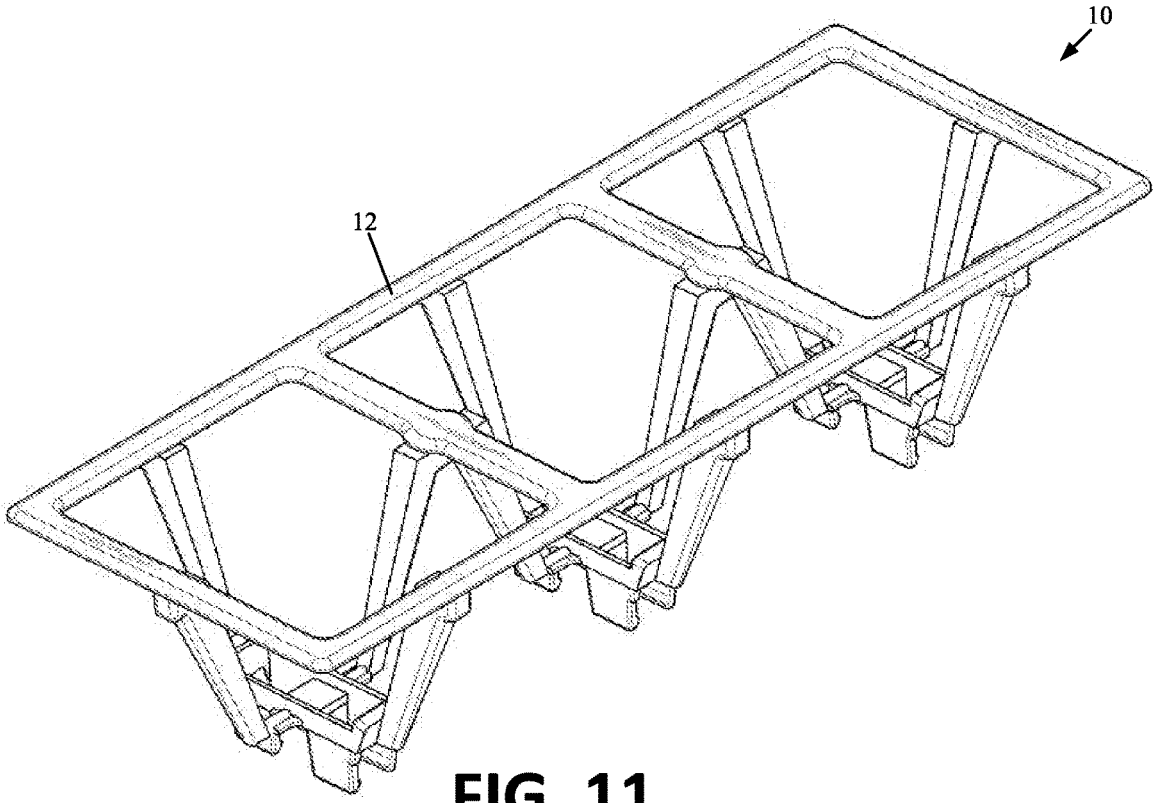
FIG. 11 is a bottom perspective view of a structure for supporting three concrete reinforcement bars in accordance with one embodiment.

FIGS. 10 and 11 depict an embodiment of a footing stand 10 having three cradles for holding three reinforcement bars in a concrete footing. The three cradles are referred to herein as the first cradle 20, second cradle 22 and third cradle 25. This embodiment is structurally the same as the two-cradle version depicted in FIGS. 1-9, except for the addition of the third cradle 25, a third pair of opposing first legs 15*a* and 15*b*, and a second pair of second legs 62*a* and 62*b* that extend upwardly from a second base support member 60*b* that is preferably identical to the first base support member 60*a*. The third cradle 25 includes a fifth pair of opposing sidewalls 40*a*-42*a* and a sixth pair of opposing sidewalls 40*b*-42*b* that are connected by a third bar-support member 38. The descriptions of the various structural features of the two-cradle stand apply as well to the similar features of the three-cradle stand.

In the various embodiments of the stand 10, all of the components are formed from one continuous piece of thermoplastic, such as polypropylene, which, though rigid enough to support the weight of the reinforcement bars, is flexible enough to allow the sidewalls 24*a*-24*b*, 26*a*-26*b*, 28*a*-28*b*, 30*a*-30*b*, 40*a*-40*b* and 42*a*-42*b* to flex outward to receive the reinforcement bars as described above. Thus, when a reinforcement bar is laid across the first cradle 20 on top of the retaining members 32 and is pressed downward, the sidewalls 24*a*-24*b* and 26*a*-26*b* flex outward to allow the reinforcement bar to slide past the retaining members 32 and snap into place in the channel C1. Similarly, when a reinforcement bar is laid across the cradle second 22 on top of the retaining members 32, and is pressed downward, the sidewalls 28*a*-28*b* and 30*a*-30*b* flex outward to allow the reinforcement bar to slide past the retaining members 32 and snap into place in the channel C2. The same applies to the third cradle 25.

As one skilled in the art will appreciate, the stand 10 as depicted in the figures is designed to be formed using an injection molding process in a two-piece injection mold. For compatibility with a two-piece mold, the legs 16*a*-16*b*, 18*a*-18*b*, 15*a*-15*b*, 62*a*-62*b*, 66 and 68 preferably lean slightly inward and have cross-sections that are preferably tapered from thicker to thinner from the lower to the upper extremities.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An apparatus for supporting reinforcement bars in a concrete structure, the apparatus comprising:

a base having a lower surface, an opposing upper surface, and a central opening;

a first pair of opposing first legs extending upwardly from the upper surface of the base, each of the first legs of the first pair having a lower end connected to the base and an upper end distally disposed from the lower end;

a second pair of opposing first legs extending upwardly from the upper surface of the base, each of the first legs of the second pair having a lower end connected to the base and an upper end distally disposed from the lower end;

a first base support member connected to the base and spanning the central opening, the first base support member disposed between the first and second pairs of opposing first legs, the first base support member having a lower surface and an opposing upper surface;

a first pair of second legs extending upwardly from the upper surface of the first base support member, each of the second legs of the first pair having a lower end connected to the first base support member and an upper end distally disposed from the lower end;

a first cradle attached to the upper ends of the first pair of opposing first legs and to the upper end of one of the second legs, the first cradle for receiving and holding a first reinforcement bar; and a second cradle attached to the upper ends of the second pair of opposing first legs and to the upper end of one of the second legs, the second cradle for receiving and holding a second reinforcement bar substantially in parallel with the first reinforcement bar.

2. The apparatus of claim 1 further comprising:

the base having a first end and a second end;

the first pair of opposing first legs attached to the base at a location between the first base support member and the first end of the base;

the second pair of opposing first legs attached to the base at a location between the first base support member and the second end of the base;

a third leg extending upwardly from the upper surface of the first end of the base, the third leg having a lower end connected to the base and an upper end connected to the first cradle; and a fourth leg extending upwardly from the upper surface of the second end of the base, the fourth leg having a lower end connected to the base and an upper end connected to the second cradle.

3. The apparatus of claim 1 wherein the central opening of the base is defined by an inner edge that forms a rectangle having filleted corners.

4. The apparatus of claim 1 wherein each of the first legs includes a foot that extends outwardly from the base where the first leg connects to the base.

5. The apparatus of claim 1 wherein each of the second legs includes a foot connected to the upper surface of the first base support member.

6. The apparatus of claim 1 further comprising:

the first and second cradles each comprising one or more pairs of opposing sidewalls separated by a channel, and each of the sidewalls having a top edge; and retaining members protruding inwardly from the top edges of the opposing sidewalls toward the channel, the retaining members having an upper surface slanting downward at an angle with respect to the first and second upper sidewalls to guide and retain the reinforcement bars within the cradles.

7. The apparatus of claim 6 wherein the each of the retaining members further comprises a lower surface that extends inwardly from each of the sidewalls toward the channel.

8. The apparatus of claim 1 wherein the base, first base support member, legs, and cradles comprise a unitary structural element.

9. The apparatus of claim 8 wherein the base, first base support member, legs, and cradles are formed from a continuous piece of thermoplastic material.

10. The apparatus of claim 1 further comprising:

a third pair of opposing first legs extending upwardly from the upper surface of the base, each of the first legs of the third pair having a lower end connected to the base and an upper end distally disposed from the lower end;

a second base support member connected to the base and spanning the central opening, the second base support member disposed between the second and third pairs of opposing first legs, the second base support member having a lower surface and an opposing upper surface;

a second pair of second legs extending upwardly from the upper surface of the second base support member, each having a lower end connected to the second base support member and an upper end distally disposed from the lower end, the upper end of one of the second pair of second legs attached to the second cradle; and a third cradle attached to the upper ends of the third pair of opposing first legs and to the upper end of one of the second pair of second legs, the third cradle for receiving and holding a third reinforcement bar.

11. The apparatus of claim 10 further comprising:

the base having a first end and a second end;

a third leg extending upwardly from the upper surface of the first end of the base, the third leg having a lower end connected to the base and an upper end connected to the first cradle; and a fourth leg extending upwardly from the upper surface of the second end of the base, the fourth leg having a lower end connected to the base and an upper end connected to the third cradle.

12. An apparatus for supporting reinforcement bars in a concrete structure, the apparatus comprising:

a base having a lower surface, an opposing upper surface, and a central opening;

a first of pair of opposing first legs extending upwardly from the upper surface of the base, each of the first legs having:

a lower portion connected to the base;

an upper portion disposed distally from the lower portion; and a first shoulder extending horizontally from either side of the upper portion;

a second of pair of opposing first legs extending upwardly from the upper surface of the base, each of the first legs having:

a lower portion connected to the base;

an upper portion disposed distally from the lower portion; and a second shoulder extending horizontally form either side of the upper portion;

a first base support member connected to the base and spanning the central opening, the first base support member disposed between the first and second pairs of opposing first legs, the first base support member and having a lower surface and an opposing upper surface;

a first pair of second legs extending upwardly from the upper surface of the first base support member, each of the second legs of the first pair having:

a lower portion connected to the first base support member;

an upper portion disposed distally from the lower portion; and a first neck member extending horizontally from the upper portion;

a first cradle forming a first channel for receiving and holding a first reinforcement bar, the first cradle comprising:

a first pair of opposing sidewalls connected to the first shoulder of a first one of the first legs of the first pair, the first channel being disposed between the first pair of opposing sidewalls;

a second pair of opposing sidewalls connected to the first shoulder of a second of the of the first legs of the first pair, the first channel being disposed between the second pair of opposing sidewalls; and a first central bar-support member connecting the first pair of opposing sidewalls to the second pair of opposing sidewalls, the first central bar-support member being connected to a first one of the first neck members; and a second cradle forming a second channel for receiving and holding a second reinforcement bar substantially in parallel with the first reinforcement bar, the second cradle comprising:

a third pair of opposing sidewalls connected to the second shoulder of a first one of the first legs of the second pair, the second channel being disposed between the third pair of opposing sidewalls;

a fourth pair of opposing sidewalls connected to the second shoulder of a second one of the first legs of the second pair, the second channel being disposed between the fourth pair of opposing sidewalls; and a second central bar-support member connecting the third pair of opposing sidewalls to the fourth pair of opposing sidewalls, the second central bar-support member being connected to a second one of the first neck members.

13. The apparatus of claim 12 wherein:

the first cradle further comprises:

first upper fillets that connect the first pair of opposing sidewalls to the first shoulder of the first one of the first pair of first legs; and second upper fillets that connect the second pair of opposing sidewalls to the first shoulder of the second one of the first pair of first legs; and the second cradle further comprises:

third upper fillets that connect the third pair of opposing sidewalls to the second shoulder of the first one of the second pair of first legs; and fourth upper fillets that connect the fourth pair of opposing sidewalls to the second shoulder of the second one of the second pair of first legs.

14. The apparatus of claim 12 further comprising:

the base having a first end and a second end;

the first pair of opposing first legs disposed between the first base support member and the first end of the base;

the second pair of opposing first legs disposed between the first base support member and the second end of the base;

a third leg extending upwardly from the upper surface of the first end of the base, the third leg having:

a lower portion connected to the base;

an upper portion disposed distally from the lower portion; and a second neck member extending horizontally from the upper portion of the third leg, the second neck member connected to the first central bar-support member of the first cradle; and a fourth leg extending upwardly from the upper surface of the second end of the base, the fourth leg having:

a lower portion connected to the base;

an upper portion disposed distally from the lower portion; and a third neck member extending horizontally from the upper portion of the fourth leg, the third neck member connected to the second central bar-support member of the second cradle.

15. The apparatus of claim 12 wherein the base is rectangular and has:

opposing and parallel first and second ends; and opposing and parallel first and second sides disposed between the first and second ends, wherein the first base support member has:

a first end connected to the first side of the base; and a second end connected to the second side of the base.

16. The apparatus of claim 12 further comprising:

top edges on the opposing first and second sidewalls of the first cradle;

first retaining members protruding inwardly from the top edges of the opposing first and second sidewalls of the first cradle toward the first channel, the first retaining members having an upper surface slanting downward at an angle with respect to the first and second sidewalls to guide and retain a reinforcement bar within the first cradle;

top edges on the opposing first and second sidewalls of the second cradle; and second retaining members protruding inwardly from the top edges of the opposing first and second sidewalls of the second cradle toward the second channel, the second retaining members having an upper surface slanting downward at an angle with respect to the first and second sidewalls to guide and retain a reinforcement bar within the second cradle.

17. The apparatus of claim 16 wherein the each of the first and second retaining members further comprises a lower surface that extends inwardly from each of the sidewalls toward the corresponding first or second channel.

18. The apparatus of claim 12 further comprising:

a third of pair of opposing first legs extending upwardly from the upper surface of the base, each of the first legs of the third pair having:

a lower portion connected to the base;

an upper portion disposed distally from the lower portion; and a third shoulder extending horizontally form either side of the upper portion;

a second base support member connected to the base and spanning the central opening, the second base support member disposed between the second and third pairs of opposing first legs, the second base support member and having a lower surface and an opposing upper surface;

a second pair of second legs extending upwardly from the upper surface of the second base support member, each of the second legs of the second pair having:

a lower portion connected to the first base support member;

an upper portion disposed distally from the lower portion; and a second neck member extending horizontally from the upper portion, wherein one of the second neck members of the second pair of second legs is attached to the second cradle; and a third cradle forming a third channel for receiving and holding a third reinforcement bar, the third cradle comprising:

a fifth pair of opposing sidewalls connected to the third shoulder of a first one of the first legs of the third pair, the third channel being disposed between the fifth pair of opposing sidewalls;

a sixth pair of opposing sidewalls connected to the third shoulder of a second of the first legs of the third pair, the third channel being disposed between the sixth pair of opposing sidewalls; and a third central bar-support member connecting the fifth pair of opposing sidewalls to the sixth pair of opposing sidewalls, the third central bar-support member being connected to one of the second neck members of one of the second legs.

19. The apparatus of claim 18 further comprising:

the base having a first end and a second end;

a third leg extending upwardly from the upper surface of the first end of the base, the third leg having:

a lower portion connected to the base;

an upper portion disposed distally from the lower portion; and a third neck member extending horizontally from the upper portion of the third leg, the third neck member connected to the first central bar-support member of the first cradle; and a fourth leg extending upwardly from the upper surface of the second end of the base, the fourth leg having:

a lower portion connected to the base;

an upper portion disposed distally from the lower portion; and a fourth neck member extending horizontally from the upper portion of the fourth leg, the fourth neck member connected to the third central bar-support member of the third cradle.

* * * * *